United States Patent [19]

Brouwer

[11] 4,299,557

[45] Nov. 10, 1981

[54] FUEL BURNER CONTROL CIRCUIT

[75] Inventor: Frans Brouwer, Glencoe, Ill.

[73] Assignee: Harper-Wyman Company, Hinsdale, Ill.

[21] Appl. No.: 81,202

[22] Filed: Oct. 2, 1979

[51] Int. Cl.[3] ..... F23Q 9/12

[52] U.S. Cl. ..... 431/71; 431/73; 431/74; 307/117

[58] Field of Search ..... 307/117, 106; 431/69, 431/71, 73, 46, 78; 340/577, 579; 328/6

[56] References Cited

U.S. PATENT DOCUMENTS

| | | | |
|---|---|---|---|
| 3,671,815 | 6/1972 | Eberle et al. | 340/579 X |
| 3,727,073 | 4/1973 | Cade | 307/117 |
| 4,019,854 | 4/1977 | Carlson et al. | 431/78 X |
| 4,168,947 | 9/1979 | Matthews | 431/69 X |

*Primary Examiner*—L. T. Hix
*Assistant Examiner*—James L. Dwyer
*Attorney, Agent, or Firm*—Mason, Kolehmainen, Rathburn & Wyss

[57] ABSTRACT

A circuit for safely admitting fuel to a burner, igniting the fuel, detecting the presence of flame at the burner, and preventing the escape of unburned fuel from the burner if ignition is not accomplished or the flame is interrupted. An initiation circuit operates a control signal generator during a time delay period and a valve operating circuit opens a fuel valve to admit fuel to a burner. An igniter circuit is operated in response to energization of the valve operating circuit to produce sparks for ignition of the fuel. A flame detector circuit powered by the valve operating circuit detects the presence of flame and, in response, the operation of the control signal generator is maintained and the operation of the ignition circuit is interrupted. The operation is fail-safe, the detection of flame is reliable despite power supply variations, and no power supply transformer or valve operating relay is required.

18 Claims, 1 Drawing Figure

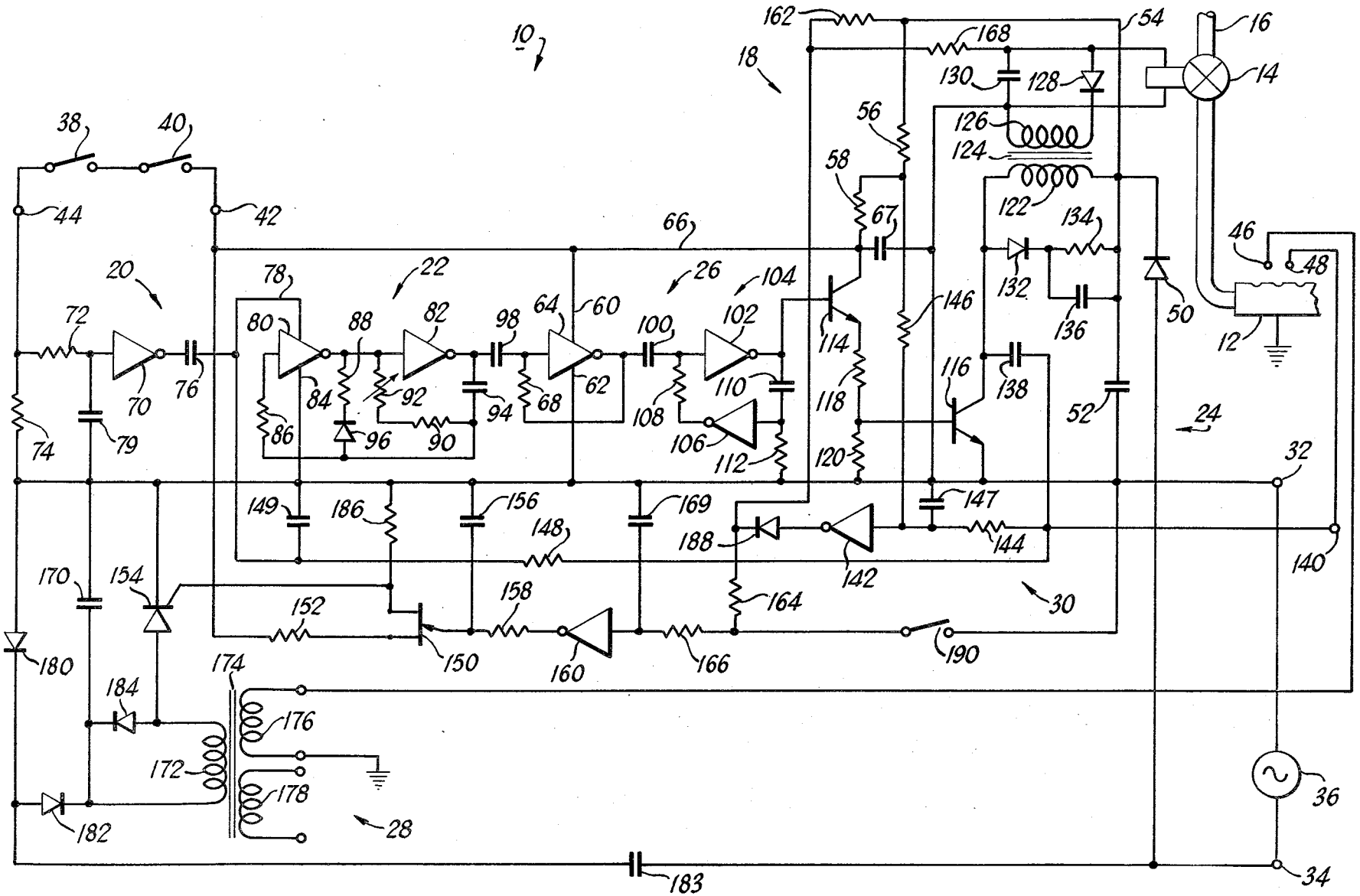
10
12
14
16
18
20
22
24
26
28
30
32
34
36
38
40
42
44
46
48
50
52
54
56
58
60
62
64
66
67
68
70
72
74
76
78
79
80
82
84
86
88
90
92
94
96
98
100
102
104
106
108
110
112
114
116
118
120
122
124
126
128
130
132
134
136
138
140
142
144
146
147
148
149
150
152
154
156
158
160
162
164
166
168
169
170
172
174
176
178
180
182
183
184
186
188
190

FUEL BURNER CONTROL CIRCUIT

The present invention relates to improvements in control circuits for fuel burners such as gas burners, and more particularly to a circuit which safely and automatically controls the ignition and monitoring of a flame at a burner.

In the operation of fuel burners it may be extremely important reliably to prevent the escape of unburned fuel from the burner. For example, the emission of unburned fuel from the burner of a gas oven, which may be caused by temporary interruption of the fuel supply or the like, can result in an unsafe and unsuspected accumulation of fuel and the danger of fire and explosion. To prevent this dangerous condition, in the past it has been conventional to detect the presence of flame at the burner or at an adjacent pilot burner and to close a fuel supply valve in the absence of flame. Typically this has been accomplished with a mercury-filled device including a bulb subjected to flame and communicating with an expansible diaphragm controlling a valve.

In the past the most common method of igniting a burner such as a gas oven burner has been to use a continuous or standing pilot burner. However, due to the fuel wastage associated with a continuously burning igniter pilot, it has become desirable to employ an intermittently operating, electrically powered igniter system which utilizes power only when fuel ignition is necessary.

The present invention is concerned with a control circuit for a fuel burner which provides intermittent electrical spark ignition of the burner and which monitors the presence of flame without the use of mercury-filled or other mechanical devices. While circuits of this character have been proposed in the past, known circuits have suffered from disadvantages including cost and complexity, possible unreliability in the important flame detection function, the necessity for expensive components such as power supply transformers and valve control relays, and others.

Among the important objects of the present invention are to provide an improved fuel burner control circuit; to provide a circuit having an efficient and reliable power supply requiring no power transformer; to provide a circuit having an improved valve operating circuit avoiding the necessity for a valve operating relay; to provide a flame detection circuit powered by the valve operating circuit in a manner providing reliable operation despite power supply variances or misconnections; to provide an improved arrangement for coupling a control signal to the valve operating circuit to prevent damage to its components; to provide an improved arrangement for controlling the interruption of ignition when flame is established; and to provide a fail-safe, reliable and inexpensive burner control circuit overcoming disadvantages of circuits used in the past.

In brief, in accordance with the above and other objects of the present invention, there is provided a control circuit for use with a burner supplied with fuel from an electrically operated valve, and having associated therewith a spark ignition electrode adjacent the burner and a flame probe disposed in the burner flame region and spaced from a point of ground at or near the burner. The control circuit includes an igniter circuit connected to the spark electrodes for producing ignition sparks, and a valve operating circuit connected in controlling relation to the electrically operated valve. A control signal generating circuit is coupled to the valve operating circuit to open the valve and admit fuel to the burner when a control signal is generated.

An initiation circuit having a time delay characteristic initiates burner operation by applying an operating signal of limited duration to the control signal generating circuit thereby to open the valve. The valve operating circuit is coupled to the ignition circuit for energizing the ignition circuit in response to opening of the valve for ignition of fuel at the burner.

A flame detection circuit is connected to the flame probe and is powered from the valve operating circuit. The flame detection circuit is coupled to the control signal generating circuit so that when burner flame is detected, a continuing operating signal is supplied to the control signal generating circuit to maintain burner operation beyond the limited initial period. The flame detection circuit is connected to the ignition circuit for interrupting operation of the ignition circuit when burner flame is detected.

The valve operating circuit includes a power transistor having output terminals connected across a source of operating potential in series with an inductive device, such as a transformer, which in turn is coupled to the electrically operated valve without the use of a relay. The transistor is operated between conductive and non-conductive states in response to the application of the generated control signal to effect opening of the valve.

The flame detection circuit includes a capacitor connected in series with the flame probe so that flame rectification results in a charge on the capacitor. The capacitor is connected to a point in the valve operating circuit between one power transistor output terminal and the inductive device. The frequency of operation of the power transistor and the amplitude of the flame probe driving signal are such that a capacitor charge level indicative of flame is produced only when the proper driving signal is applied and not if a signal of the line voltage amplitude or frequency is inadvertently applied. The flame probe circuit provides a reliable indication of flame despite variations in the power supply voltage or interchange of the power supply terminals.

Secondary breakdown of the power supply transistor due to leakage inductance in its output circuit is prevented despite the use of a capacitive time delay circuit coupled to the input of the control signal generator. The control signal comprises a square wave coupled to the input of the power supply transformer. Even if the square wave tends to degenerate due to gradual turn off of the control signal generator, a waveform shaping circuit coupled between the generator and the power transistor input provides a sharp square wave signal. The waveform shaping circuit includes a first gate connected in series between the generator and the transistor, and a feedback gate connected from the output to the input of the first gate to provide abrupt operation.

The control circuit includes a power supply circuit avoiding the need for a power supply transformer, and including a rectifier circuit for developing a first DC potential for operation of the valve operating circuit. A voltage divider connected to the rectifier circuit provides other DC potentials for operating other parts of the control circuit. An amplifier gate connected between the control circuit generator and the valve operating circuit is part of the voltage divider and provides a regulated voltage for operation of gates incorporated in the control circuit.

The ignition circuit includes a unijunction transistor having a charging circuit serving to operate the unijunction transistor and thereby gate the ignition circuit to provide sparks at the spark electrodes. The charging circuit is supplied directly with an output from a gate controlled by the flame probe circuit for interrupting ignition in the presence of flame.

The present invention together with the above and other objects and advantages thereof may be best understood from the following detailed description of the embodiment of the invention shown in the accompanying drawing.

The single FIGURE of the drawing is a schematic and diagrammatic illustration of a fuel burner system including a control circuit constructed in accordance with the present invention.

Having reference now to the accompanying drawing, there is illustrated a fuel burner control circuit constructed in accordance with the principles of the present invention and designated as a whole by the reference numeral 10. The circuit 10 in the illustrated arrangement is associated with a fuel burner installation including a gas oven burner 12 supplied with fuel by a normally closed, electrically operated gas valve 14 connected by a conduit 16 with a source of gas fuel under pressure. While the present invention is illustrated in connection with a gas oven burner 12, principles of the present invention are applicable to burner installations of other types. For example, the circuit could be associated with a burner system wherein a pilot light is controlled by the control circuit 10 and is in turn used to ignite a main burner. In addition, features of the circuit 10 could be used in connection with burners other than oven burners and with burners using fuel other than gas.

In general, the control circuit 10 includes a power supply section generally designated as 18 for providing operating potentials for the circuit 10, and an initiation circuit generally designated as 20 for initiating operation of the burner 12. A control signal generating circuit generally designated as 22 provides a control signal in response to operation of the initiation circuit 20 for operating a valve operating circuit generally designated as 24 in order to open the valve 14. An amplifier and wave shaping or rise and fall time control circuit generally designated as 26 interconnects the control signal generating circuit 22 and the valve operating circuit 24.

An ignition circuit generally designated as 28 serves to ignite fuel emitted from the burner 12, and is operated in response to operation of the valve operating circuit 24. A flame detection circuit generally designated as 30 responds to the presence of flame at the burner and maintains the control signal generating circuit 22 in operation while discontinuing operation of the ignition circuit 28.

Circuit 10 includes a pair of power supply terminals 32 and 34 adapted to be connected respectively to the neutral and the line conductors of a source 36 of AC line voltage, typically a sixty hertz, nominal 110 volt source. Operation of the circuit is initiated by closure of a manual on-off switch 38 and a thermostatically controlled switch 40 connected to a pair of control terminals 42 and 44 of the circuit 10. When these switches are closed, the initiation circuit 20 is operated to provide a time delay, trial-for-ignition period during which the control signal generating circuit 22 and valve operating circuit 24 are energized to open valve 14 and admit fuel to burner 12.

The ignition circuit 28 is energized in response to opening of valve 14 to provide ignition sparks at a spark ignition electrode 46 disposed adjacent the burner 12. If flame is established during the time delay period, the presence of flame is detected by the flame detection circuit 30 coupled to a flame probe 48 disposed adjacent the burner 12.

Detection of flame during the time delay period established by the initiation circuit 20 results in deenergization of the ignition circuit 28 and in continuing operation of the control signal generating circuit 22 and valve operating circuit 24 until such time as switch 38 or switch 40 is opened. If flame is not established at burner 12 during the time delay period, operation of the control signal generating circuit 22 is discontinued and the valve operating circuit 24 and ignition circuit 28 cease to operate. No further operation is then possible until the switch 38 or the switch 40 opens and recloses. If burner flame is interrupted, the ignition circuit 28 is reoperated during another time delay, trial-for-ignition period.

Proceeding now to a more detailed description of the control circuit 10, the power supply section 18 advantageously does not utilize a power supply transformer. Circuit 18 includes a rectifier circuit composed of a diode 50 and a capacitor 52 connected in series with one another across the power supply terminals 32 and 34 for developing an unregulated DC potential of approximately 165 volts at a conductor or circuit node 54. Conductor 54 is coupled to the neutral power supply terminal 32 by a voltage divider network including a pair of voltage divider resistors 56 and 58 and the power supply terminals 60 and 62 of a gate 64.

Gate 64, as described below, operates as an amplifier in the amplifier and wave shaping circuit 26. In addition, the gate 64 provides a regulated voltage at a conductor 66 located in the voltage divider network between the resistor 58 and the gate 64. A power supply filter capacitor 67 is connected between conductor 66 and the neutral power supply terminal 32. A resistor 68 connected between the output and the input of gate 64 operates the gate in an intermediate mode between its extreme logic states in which it draws current from conductor 66. The gate thus functions as a constant voltage, variable resistance to maintain conductor 66 at a regulated voltage which in the illustrated embodiment of the invention is approximately 11 volts.

An advantage of the power supply section 18 of the present invention is that the use of a zener diode or other additional voltage regulating device is not required. Moreover, in the standby condition prior to operation of the burner 12, the gate 64 is the only operating active circuit component and the current utilized by the circuit 10 in the standby condition is extremely small.

In the standby condition prior to initiation of operation of the burner 12, the electrically operated valve 14 is in its normally closed condition and fuel does not reach the burner. The switch 38 and/or switch 40 is in its open condition and the components of the circuit 10 except for the gate 64 are not energized. When operation of the burner 12 is demanded by closure of the manually operated switch 38 and by simultaneous closure of the thermostatically operated switch 40, the circuit 10 serves to admit fuel to the burner, to ignite the fuel, and to continuously monitor the burner operation.

More specifically, the initiation circuit includes a gate 70 with its input normally at a low or zero level due to connection to the neutral power supply terminal 32 through a pair of resistors 72 and 74. The output of gate 70 is therefore normally at a high level, and a time delay capacitor 76 is charged to approximately 11 volts since it is coupled to the neutral power supply terminal 32 through internal circuitry of components of the control signal generating circuit 22.

When switches 38 and 40 are closed, the input of gate 70 assumes a high level by virtue of its connection through resistor 72 and switches 38 and 40 to the conductor 66. As a result, the output of gate 70 drops to a low or zero level and the charge on the capacitor 76 causes a negative operating potential to be applied to a conductor or circuit node 78. A capacitor 79 filters switching transients.

Circuit node 78 comprises the output of the initiation circuit 20 as well as an input terminal of the control signal generating circuit 22. Point 78 remains negative and below a predetermined cutoff potential for a time delay period, for example four seconds, during which fuel is admitted to burner 12 and ignition of the fuel is attempted.

The control signal generating circuit 22 includes a pair of gates 80 and 82 operating as a free running astable multivibrator generating a control signal in the form of a square wave output signal at the output of gate 82. The control signal generator operates only when a negative supply voltage is applied to input or power supply terminal 78 relative to the system neutral voltage applied to another power supply or input terminal 84 connected to the neutral power supply terminal 32.

A feedback and frequency determining network including resistors 86, 88, 90 and 92, capacitor 94 and diode rectifier 96 is associated with gates 80 and 82. Resistor 92 is a trimmer or variable resistor for adjusting the duty cycle of the multivibrator—i.e., the ratio of on time to the period of the square wave output signal.

When the initiation circuit 20 operates, the negative operating signal applied by way of conductor 78 results in operation of the generating circuit 22 to produce a square wave output. The voltage across the capacitor 76 gradually decreases during the time delay period as the capacitor 76 discharges due to current flow from gate terminal 78. The initial voltage across the terminals 78 and 84 is approximately eleven volts. When this voltage increases to a cutoff voltage of approximately negative two volts, the generating circuit 22 discontinues operation. In the illustrated arrangement, this provides a time delay or trial-for-ignition period of approximately four seconds.

The square wave control signal from the generating circuit 22 in the illustrated arrangement has a frequency of about eight kilohertz and an amplitude of about minus four volts. This signal is coupled through a capacitor 98 to the input of the gate 64. Gate 64 operates as an amplifier and inverts the signal while increasing its amplitude to about eleven volts. As indicated above, the gate 64 also provides a regulated DC voltage at conductor 66.

The output of amplifier gate 64 is coupled through a capacitor 100 to the input of a gate 102 forming part of a pulse shaping circuit generally designated as 104. A gate 106 in series with a resistor 108 and cooperating with a circuit including a capacitor 110 and resistor 112 provides a feedback control system causing gate 102 to operate with minimum rise and fall times. Consequently, the output of the gate 102 is a sharp square wave with an amplitude of approximately eleven volts.

The valve operating circuit 24 functions to open the fuel valve 14 and to initiate operation of the ignition circuit 28 in response to the control signal applied by the generating circuit 22 and the circuit 26. A transistor 114 and a power transistor 116 operate in a manner similar to a Darlington pair with a resistor 118 coupling the emitter of transistor 114 to the base of transistor 116, and a resistor 120 coupling the base of transistor 116 to the neutral power supply terminal 32. Power transistor 116 is periodically switched on and off in response to the square wave signal appearing at the output of gate 102.

When transistor 116 periodically conducts, it draws current from conductor or circuit node 54 through the primary winding 122 of a transformer 124. A secondary winding 126 of the transformer 124 is in series with a diode 128 and the electrically operated valve 14. A capacitor 130 in parallel with the electrically operated valve 14 is charged to a DC potential for energization of the valve.

The DC potential developed across the electrically operated valve 14 is dependent upon the on time of the power transistor 116, and thus upon the duty cycle of the multivibrator or control signal generator 22. The variable resistor 92 is adjusted to provide the desired valve operating potential which in the illustrated embodiment of the invention is approximately twelve volts.

The leakage inductance of the transformer 124 in the output circuit of the transistor 116 tends to induce high transient voltages across the transistor. These transient voltages are limited by a damper circuit including a diode 132, a resistor 134 and a capacitor 136. This permits use of a relatively inexpensive and readily available transistor capable of handling voltages under four hundred volts. The signal at the collector of transistor 116 is a square wave, or series of positive pulses, having an amplitude of about positive three hundred volts at the eight kilohertz control signal frequency.

Possible damage to the transistor 116 is avoided not only by the transient limiter circuit but also by the pulse shaping circuit 104. Since operation of the control signal generator 22 is terminated in response to a gradually decaying voltage level on capacitor 76, it may occur that the turn off point is unstable and results in a control signal square wave having slow rise and/or fall times. This could result in slow switching of the transistor 116, which is undesirable since transistor 116 during switching experiences high current and voltage conditions associated with the leakage inductance of the transformer 124. The pulse shaping circuit 104 including the feedback gate 106 assures that the signal applied to the input of transistor 116 is a sharply defined square wave with abrupt rise and fall times so that switching times of undesirably large duration are avoided.

Flame detection circuit 30 includes a capacitor 138 directly connected to the collector of transistor 116 and to a circuit terminal 140 adapted to be connected to the flame probe 48. The burner 12 is grounded so that in the presence of flame a conductive path having rectification characteristics exists between the flame probe 48 and ground.

When no flame is present at burner 12, the probe 48 is electrically isolated from ground. The input of a gate 142 is held at a high level of approximately eleven volts by a network of resistors 144 and 146 connected to the junction of voltage divider resistors 56 and 58, which junction is at approximately forty volts.

When a flame is present at burner 12, the probe 48 is coupled to ground by flame rectification. Current flow charges capacitor 138 and the voltage at the flame probe 48 and terminal 140 drops to a negative value. The difference between this negative voltage and the forty volts at the junction of resistors 56 and 58 is divided by resistors 144 and 146 to apply a low or zero input to gate 142. A capacitor 147 filters switching transients at the input of gate 142.

Unintentional grounding of the probe 48, for example to the burner 12, does not operate the gate 142 nor provide an erroneous indication of the presence of flame because division of the forty volt supply by resistors 146 and 144 is not sufficient to drop the input of gate 142 below the high level. Thus, flame rectification is necessary for operation of the flame detection circuit.

Utilization of a flame probe driving signal resulting from direct connection to the output circuit of the power transistor 116 is advantageous in avoiding false flame indications. The driving signal has an amplitude of approximately three hundred volts and is much larger than the nominal one hundred ten volt amplitude of the AC line voltage. In addition, the driving signal has a frequency of eight kilohertz which is much larger than the sixty hertz supply frequency. The amplitude of the line voltage is not large enough to charge the capacitor 138 to a negative value high enough to indicate the presence of flame. Moreover, the value of the capacitor 138 is chosen so that it presents a relatively high impedance at sixty cycles. Consequently, a false flame indication is avoided despite power supply variations, and the flame detection circuit 30 is operable even if the power supply terminals 32 and 34 are inadvertently reversed relative to the AC line voltage source.

The negative probe voltage resulting from flame rectification and charging of the capacitor 138 to a predetermined level is coupled to the control signal generator input terminal 78 through a resistor 148, with a capacitor 149 providing filtering. Thus, if flame is established during the time delay, trial-for-ignition period, the control signal generator 22 continues to operate. The time delay capacitor 76 remains charged, and if flame is interrupted, draws current from the signal generator 22 for a limited time after which the system will discontinue operation unless flame is re-established.

Ignition circuit 28 includes a unijunction transistor 150 having its base electrodes connected in series with a resistor 152 between the regulated voltage appearing at conductor 66 and the gate electrode of a silicon controlled rectifier 154. The emitter electrode of the unijunction transistor 150 is connected to a charging circuit including a capacitor 156 and a resistor 158. The charging circuit is controlled directly by a gate 160 which is in turn controlled by the flame detection circuit 30.

More specifically, in the standby condition prior to operation of the circuit 10, the ignition circuit 28 does not operate due to positive clamping of the input of gate 160 at a high level through resistors 162, 164 and 166 coupled to the conductor 54. When the electrically operated valve 14 is opened, a negative potential appearing at capacitor 130 is compared with the potential at conductor 54 across resistors 168 and 162. The values of these resistors are chosen so that a zero or low level voltage is applied to the input of gate 160 through resistors 164 and 166. Transients are filtered by a capacitor 169. Consequently, upon operation of the valve operating circuit 24, the output of gate 160 becomes positive thereby to drive the unijunction transistor charging circuit.

The charging circuit when supplied with a positive or high level signal periodically renders the unijunction transistor 150 conductive periodically to gate the SCR 154 to a conductive condition and discharge a capacitor 170 through a circuit loop including a primary winding 172 of a transformer 174. As a result, high voltages are induced in a secondary winding 176 of the transformer 174 with the result that ignition sparks are produced between the spark electrode 46 and the grounded burner 12.

In the illustrated arrangement, the spark ignition circuit 28 is used with the single burner 12, and the secondary winding 176 is connected between the spark electrode 46 and a point of ground potential. If desired, both sides of the secondary winding 176 could be connected to spark electrodes for ignition of two grounded burners. However, only one of these at any one time can be monitored for the presence of flame at probe 48 by circuit 10. Moreover, as illustrated, the transformer 174 may include one or more additional secondary windings 178 for connection to spark electrodes associated with other burners, such as, for example, stove top burners.

The capacitor 170 of the ignition circuit 28 is charged by current flow through a pair of diodes 180 and 182 connected as a voltage doubler with a capacitor 183 to the power supply terminals 32 and 34. A diode 184 is connected across the primary winding 172 to prevent inductive voltage reversal in winding 172 for protection of SCR 154. When the unijunction transistor 150 is nonconductive, the silicon controlled rectifier 154 is held in a nonconductive condition by a resistor 186 connected between its gate electrode and the neutral power supply 32.

If flame is detected after operation of the ignition circuit 28, the input of gate 142 goes from a high level to a low or zero level in response to charging of the capacitor 138 as described above. As a consequence, the output of gate 142 goes to a high level and is coupled through a diode 188 and resistors 164 and 166 to the input of gate 160. The output of the gate 160 returns to a low or zero level and discontinues the operation of the ignition circuit 28.

In the illustrated arrangement, the ignition circuit 28 can be operated manually by closing a switch 190. Closing of this switch interconnects the input of gate 160 through resistor 166 to the neutral power supply terminal 32 with the result that the output of gate 160 provides an operating potential to the charging circuit of the unijunction transistor 150. This arrangement is useful, for example, if the secondary winding 178 is used for ignition of range top burners which do not require the monitoring and control functions of the circuit 10.

In light of the preceding detailed description, the operation of the control circuit 10 is apparent. In the standby condition, prior to a demand for burner operation, the circuit is in the illustrated condition and none of the components of the circuit are operating except for the gate 64 which maintains a regulated power supply voltage at the conductor 66.

When operation is initiated by closing of switches 38 and 40, the initiation circuit 20 operates to apply a negative voltage to terminal 78 during a time delay period of approximately four seconds established by capacitor 76. During this time delay period, a control signal is generated by circuit 22 and is coupled through the amplifying and pulse shaping circuit 26. As a result, the transistor 116 is operated so that the electrically operated valve 14 is opened through the agency of the transformer 124. Simultaneously, the ignition circuit 28 is operated by switching of the gate 160 in response to voltage applied to the valve 14.

The flame detection circuit powered by a driving signal associated with the output of transistor 116 detects the presence or absence of flame. If no flame is detected during the time delay period, the control signal generator 22 ceases operation as capacitor 76 discharges. In the event that flame is detected, the negative flame probe voltage maintains the charge on capacitor 76 and continues the control signal generator circuit 22 and the valve operating circuit 24 in operation. At the same time, in response to detection of flame, the gate 142 is operated to interrupt the operation of the ignition 28. Should burner flame be extinguished thereafter, the ignition circuit 28 is reactivated and the charge on the capacitor 76 establishes another time delay period during which the valve 14 remains open.

In a control circuit 10 constructed in accordance with the present invention, the component designations and values listed below were found to provide the desired operation. This detailed information is provided for purposes of illustration and should not be understood to limit the scope of the present invention.

| | |
|---|---|
| Gates | |
| 80 and 82 | MOSFET integrated circuit CD4007BE |
| 64, 102, 106, 70, 142 and 160 | MOSFET integrated circuit CD4069BE |
| Resistors (in ohms) | |
| 56 | 15 K |
| 58 | 3900 |
| 68 and 146 | 22 M |
| 72, 74, 88, 90, 158, 164 and 166 | 1 M |
| 86 and 168 | 2.2 M |
| 92 | O-2M |
| 108 | 22 K |
| 112 | 220 K |
| 118 | 680 |
| 120 | 220 |
| 134 | 100 K |
| 144 | 10 M |
| 148 | 6.8 M |
| 152 | 100 |
| 168 | 150 K |
| 186 | 33 |
| Capacitors (in microfarads) | |
| 52 | 50 |
| 76 | 1.0 |
| 79, 136 | 0.01 |
| 94 | 27 picofarads |
| 98, 100, 138 | 0.001 |
| 130 | 100 |
| 149 | 0.05 |
| 156 | 0.22 |
| 170 | 1 |
| 169 and 183 | 0.1 |
| Transistors and Diodes | |
| 50, 132, 180, 182 and 184 | 1N4006 |
| 96 and 188 | 1N914 |
| 114 | 2N3904 |
| 116 | T1P50 |
| 128 | 1N4002 |
| 150 | 2N4871 |
| 154 | C106D |

While the invention has been described with reference to details of the illustrated embodiment, it should be understood that such details are not intended to limit the scope of the invention as defined in the following claims.

What is claimed and desired to be secured by Letters Patent of the United States is:

1. A control circuit for a fuel burner and for a solenoid valve connected to supply fuel to the burner, said control circuit comprising:

a power supply circuit including first and second power supply terminals for connection to a source of AC line voltage, and including rectifier means for providing a first DC operating signal, said power supply circuit also including a voltage divider coupled to said rectifier means for providing a second DC operating signal;

a circuit for generating a control signal having repetitive waveform and having an input and an output;

manually operated means including time delay means coupled to the input of the control signal generating circuit for operating said control signal generating circuit for a predetermined delay period;

an amplifier and waveform shaping circuit coupled to the output of said control signal generating circuit and including a plurality of gates at least one of which is an amplifier;

said amplifier gate being connected in said voltage divider to regulate said second DC operating signal;

a driving signal generating circuit connected to said rectifier means and coupled to said amplifier and waveform shaping circuit and having first and second outputs, said first output being connected to the solenoid valve for operating the valve to an open condition in response to said control signal;

said driving signal generating means including a controlled conduction device having an output circuit including said first power supply terminal and said second output;

said driving signal generating means including means for operating said controlled conduction device to produce a driving signal substantially larger in frequency and in amplitude than the AC line voltage;

a flame probe adapted to be located adjacent a point of ground potential in the path of flame at the fuel burner;

a capacitor coupled between said second output and said flame probe and providing a predetermined charge level in response to the presence of flame at the fuel burner; and means connected between said flame probe and said control signal generating circuit for maintaining said control signal generating circuit in operation after said predetermined delay period in response to the predetermined charge level.

2. A valve control and flame detecting circuit for use in a fuel burner monitoring system, said circuit comprising:

a power supply circuit having input terminals adapted for connection to a source of AC line voltage, and including a rectifier circuit for developing a DC operating potential;

a power transistor having input and output circuits;

control means connected to said input circuit for switching said power transistor between conductive and nonconductive states;

inductive means connected in series with said output circuit across said rectifier circuit;

means connected between said inductive means and the valve to be controlled for opening the valve in response to current flow in said inductive means; and a capacitor connected in series with a flame probe coupled to ground by burner flame;

said capacitor being connected to the junction of said inductive means and the power transistor output circuit.

3. The circuit of claim 2 further comprising a transient limiter circuit connected in parallel with said inductive means and including rectifier means and capacitive means in series with said rectifier means.

4. The circuit of claim 2, said inductive means including a transformer having a primary winding coupled to the output circuit.

5. The circuit of claim 4, the secondary winding of said transformer being connected by a rectifier to said valve.

6. A control and spark ignition circuit for use with a fuel burner installation of the type including an electrically operated valve for supplying fuel to the burner, spark ignition electrode means adjacent the burner, and flame probe means adjacent the burner, said circuit comprising:

an igniter circuit connected to the spark electrode means for producing ignition sparks;

a valve operating circuit connected to the valve;

a control signal generating circuit;

an initiation circuit for applying an operating signal of limited duration to said control signal generating circuit for initiating operation of the burner;

first control means connected between said control signal generating circuit and said valve operating circuit to open the valve and admit fuel to the burner in response to a generated control signal;

second control means connected between said valve operating circuit and said ignition circuit for energizing the ignition circuit in response to operation of the valve operating circuit;

a flame detection circuit connected to said flame probe means and coupled to said control signal generating circuit and effective in response to detected burner flame to supply a continuing operating signal to the control signal generating circuit to maintain burner operation beyond said limited duration;

third control means connected between said flame detection circuit and said ignition circuit for disabling the ignition circuit in response to detected burner flame;

and the improvement characterized by:

a pair of power supply terminals for connection to a source of AC line voltage;

said control signal generating circuit including means for generating a control signal having a frequency higher than the AC line frequency;

said valve operating circuit including a controlled conduction device having an input circuit coupled to said first control means for operation of said controlled conduction device at said control signal frequency;

said controlled conduction device having an output circuit coupled to said power supply terminals and including means for developing a driving signal having an amplitude larger than the AC line voltage amplitude;

said flame detection circuit including a capacitor coupled between said flame probe means and said output circuit for developing a predetermined charge level in response to flame rectification of said driving signal;

said capacitor having an impedance at the AC line frequency sufficient to prevent said predetermined capacitor charge level; and fourth control means coupled between said flame detection circuit and said control signal generating circuit for operating said control signal generating circuit in response to said predetermined generating signal.

7. The circuit of claim 6, said driving signal generating means including an inductive winding in said output circuit.

8. The circuit of claim 7, said inductive winding comprising the primary of a transformer having a secondary winding coupled by rectifier means to the electrically operated valve.

9. A circuit for monitoring the presence of flame at a fuel burner, said circuit comprising:

a flame probe and a point at ground potential spaced from one another and adapted to be located in the region of burner flame;

a pair of power supply terminals adapted for connection to a source of AC line voltage;

a capacitor connected to said flame probe;

circuit means coupled to said power supply terminals and connected to said capacitor for applying to said capacitor a driving signal having a periodic waveform with an amplitude and a frequency substantially larger than the amplitude and frequency of the AC line voltage; and flame responsive means connected to a point between said capacitor and flame probe and responsive to a predetermined capacitor charge level resulting from flame rectification of said driving signal;

said capacitor having an impedance at the line voltage frequency sufficient to prevent said predetermined capacitor charge level in response to application of said AC line voltage to said capacitor.

10. A control and spark ignition circuit for use with a fuel burner installation of the type including an electrically operated valve for supplying fuel to the burner, spark ignition electrode means adjacent the burner, and flame probe means adjacent the burner, said circuit comprising:

an igniter circuit connected to the spark electrode means for producing ignition sparks;

a valve operating circuit connected to the valve;

a control signal generating circuit;

an initiation circuit for applying an operating signal of limited duration to said control signal generating circuit for initiating operation of the burner;

first control means connected between said control signal generating circuit and said valve operating circuit to open the valve and admit fuel to the burner in response to a generated control signal;

second control means connected between said valve operating circuit and said ignition circuit for energizing the ignition circuit in response to operation of the valve operating circuit;

a flame detection circuit connected to said flame probe means and coupled to said control signal generating circuit and effective in response to detected burner flame to supply a continuing operating signal to the control signal generating circuit to maintain burner operation beyond said limited duration;

third control means connected between said flame detection circuit and said ignition circuit for disabling the ignition circuit in response to detected burner flame;

and the improvement characterized by:

said control signal generating means comprising an astable multivibrator having a square wave output in response to an operating signal of predetermined amplitude;

said initiation circuit including capacitive time delay means and said signal of limited duration having a time delay characteristic;

said valve operating circuit including a power transistor operating between conductive and nonconductive states in synchronism with said square wave; and said first control means including wave shaping means for preventing gradual switching of said power transistor between said states.

11. The circuit of claim 10, means including said capacitive time delay means coupling said flame detection means to said control signal generating means.

12. The circuit of claim 11, said wave shaping means including a first gate means coupled in series between said control signal generating circuit and said power transistor, and feedback gate means coupled from the output to the input of said first gate means.

13. A control and spark ignition circuit for use with a fuel burner installation of the type including an electrically operated valve for supplying fuel to the burner, spark ignition electrode means adjacent the burner, and flame probe means adjacent the burner, said circuit comprising:

an igniter circuit connected to the spark electrode means for producing ignition sparks;

a valve operating circuit connected to the valve;

a control signal generating circuit;

an initiation circuit for applying an operating signal of limited duration to said control signal generating circuit for initiating operation of the burner;

first control means connected between said control signal generating circuit and said valve operating circuit to open the valve and admit fuel to the burner in response to a generated control signal;

second control means connected between said valve operating circuit and said ignition circuit for energizing the ignition circuit in response to operation of the valve operating circuit;

a flame detection circuit connected to said flame probe means and coupled to said control signal generating circuit and effective in response to detected burner flame to supply a continuing operating signal to the control signal generating circuit to maintain burner operation beyond said limited duration;

third control means connected between said flame detection circuit and said ignition circuit for disabling the ignition circuit in response to detected burner flame;

and the improvement characterized by:

said valve operating circuit including a transistor having an input circuit coupled to said first control means and a pair of output terminals;

inductive means connected in series with said transistor output terminals and a source of AC line voltage;

rectifier means connected in series with said inductive means and the electrically operated valve;

capacitive means connected in parallel with the valve; and said flame detection circuit being connected to said inductive means.

14. The circuit of claim 13, said flame detection circuit including a capacitor connected in series circuit relation with the flame probe means, said capacitor being connected to a point between said inductive means and one of said transistor output terminals.

15. The circuit of claim 14, the other of said transistor output terminals being connected to a neutral terminal of the AC line voltage source.

16. The circuit of claim 15, said inductive means comprising a transformer having a primary winding connected to said transistor output terminals and a secondary winding coupled to said valve by said rectifier means.

17. A control and spark ignition circuit for use with a fuel burner installation of the type including a electrically operated valve for supplying fuel to the burner, spark ignition electrode means adjacent the burner, said flame probe means adjacent the burner, said circuit comprising:

an igniter circuit connected to the spark electrode means for producing ignition sparks;

a valve operating circuit connected to the valve;

a control signal generating circuit;

an initiation circuit for applying an operating signal of limited duration to said control signal generating circuit for initiating operation of the burner;

first control means connected between said control signal generating circuit and said valve operating circuit to open the valve and admit fuel to the burner in response to a generated control signal;

second control means connected between said valve operating circuit and said ignition circuit for energizing the ignition circuit in response to operation of the valve operating circuit;

a flame detection circuit connected to said flame probe means and coupled to said control signal generating circuit and effective in response to detected burner flame to supply a continuing operating signal to the control signal generating circuit to maintain burner operation beyond said limited duration;

third control means connected between said flame detection circuit and said ignition circuit for disabling the ignition circuit in response to detected burner flame;

and the improvement characterized by:

said igniter circuit including a spark transformer having a secondary winding coupled to the spark ignition electrode means and having a primary winding;

gated capacitive discharge means connected to said primary winding including gating means for periodically producing current pulses in said primary winding and ignition sparks at the burner;

said gating means including a unijunction transistor having a control electrode;

a charging circuit connected to said control electrode; and said second control means including a gate having a normally low output connected to said charging circuit for normally preventing operation of said unijunction transistor, said gate being switched to a high output condition in response to opening of said valve.

18. The circuit of claim 17, means coupling said flame detection circuit to said gate for switching said gate to a low output condition in response to detected flame.

* * * * *